US006652347B1

(12) United States Patent
Stevkovski

(10) Patent No.: US 6,652,347 B1
(45) Date of Patent: Nov. 25, 2003

(54) ENTERTAINMENT DEVICE

(76) Inventor: Saso Stevkovski, 761 Lion Str., Rochester Hills, MI (US) 48307

( * ) Notice: Subject to any disclaimer, the term of this patent is extended or adjusted under 35 U.S.C. 154(b) by 0 days.

(21) Appl. No.: 10/236,979

(22) Filed: Sep. 9, 2002

(51) Int. Cl.[7] ..... A03H 33/12
(52) U.S. Cl. ..... 446/102; 434/211; 273/153
(58) Field of Search ..... 446/85, 102, 104, 446/106, 108, 115, 116, 119, 120, 122, 124, 127; 434/211–214; 273/153 R, 156, 157 R, 153 S

(56) References Cited

U.S. PATENT DOCUMENTS 4,415,158 A * 11/1983 Engel ..... 273/153 S
4,550,040 A * 10/1985 Fisher ..... 428/33
4,580,783 A * 4/1986 Cohan ..... 273/153 S
4,978,126 A * 12/1990 Morosow et al. ..... 273/153 S
6,244,597 B1 * 6/2001 Matijek ..... 273/153 S

* cited by examiner

*Primary Examiner*—Derris H. Banks
*Assistant Examiner*—Bena B. Miller

(57) ABSTRACT

An entertainment device comprising a plurality of rotational member divided into two groups: triangular members 10 and pentagonal members 20, a plurality of arcuate movable pieces 30 and a base for rotatably supporting said triangular and pentagonal members. The respective axes of rotation of said triangular and pentagonal members intersect at a common point representing the center of the exterior spherical surface of the device. The triangular and the pentagonal members are symmetrically disposed with regards to said center, wherein each triangular member is centrally positioned between three pentagonal members, and each pentagonal member is centrally positioned between five triangular members. Moveable pieces are disposed and slidably attached in the areas between a triangular and a corresponding neighboring pentagonal member, wherein a subsequent rotation of the triangular and pentagonal members results in changing the disposal of the moveable pieces relative to the center.

10 Claims, 11 Drawing Sheets

ENTERTAINMENT DEVICE

CROSS-REFERENCE TO RELATED APPLICATIONS

Not applicable.

STATEMENT REGARDING FEDERALLY SPONSORED RESEARCH AND DEVELOPMENT

Not applicable.

BACKGROUND

1. Field of Invention

This invention relates generally to an entertainment device and in particular to an entertainment device which allows a player to rearrange the combinations of a plurality of moveable pieces. It also relates to a mechanism for providing independent movement of spherical surface members and applications thereof.

BACKGROUND

2. Description of Prior Art

Intellectual entertainment toys are available in the market which require the players to achieve a desired result or win the game. Prior art includes puzzles formed by intersecting defined circular members each of which is rotatable about its center and each of which comprises a plurality of discrete pieces formed by intersecting arcs of the members (Fisher a U.S. Pat. No. 4,550,040; Cohan at U.S. Pat. No. 4,580,783; Morosow at U.S. Pat. No. 4,978,126). All of the above inventions disclose devices where circular members are substantially planar and axes of rotation are mutually parallel. Moreover, they require a frame for guiding and limiting the movement of the circular members.

SUMMARY OF THE INVENTION

It is an object of the present invention to provide an entertainment device of intellectual, educational and amusing character formed by intersecting defined conical members and where the moveable elements travel onto a spherical surface. Furthermore, the present invention discloses a device that exhibits a novel ad simple kinematics and requires simplified structure, or frame, for supporting and guiding the moving elements, the working principle being applicable to both spherical and planar embodiments.

Another object is to provide a mechanism for altering the relative orientation of different items of apparatus on the surface of a spherical object.

The following description will emphasize an entertainment device but the correspondence between these devices and the engineering problems of altering the relation between instruments onto a spherical base should be recalled throughout.

To achieve the above objects, in accordance with the present invention, there is provided a device comprising a plurality of triangular members, a plurality of pentagonal members, a plurality of arcuate movable pieces and a base for rotatably supporting said triangular and pentagonal members. The respective axes of rotation of said triangular and pentagonal members intersect at a common point representing the center of the exterior spherical surface of the device. The triangular and the pentagonal members are symmetrically disposed with regards to said center, wherein each triangular member is surrounded by three pentagonal members, and each pentagonal member is surrounded by five triangular members. Moveable pieces are disposed and slidably attached in the areas between a triangular and a neighboring pentagonal member, wherein a subsequent rotation of the triangular and pentagonal members results in changing the disposal of the moveable pieces relative to the center.

DRAWING FIGURES

The features and objects of the invention will be better understood from the following detailed description of the typical embodiments illustrated in the accompanying drawings in which.

Figure 1:
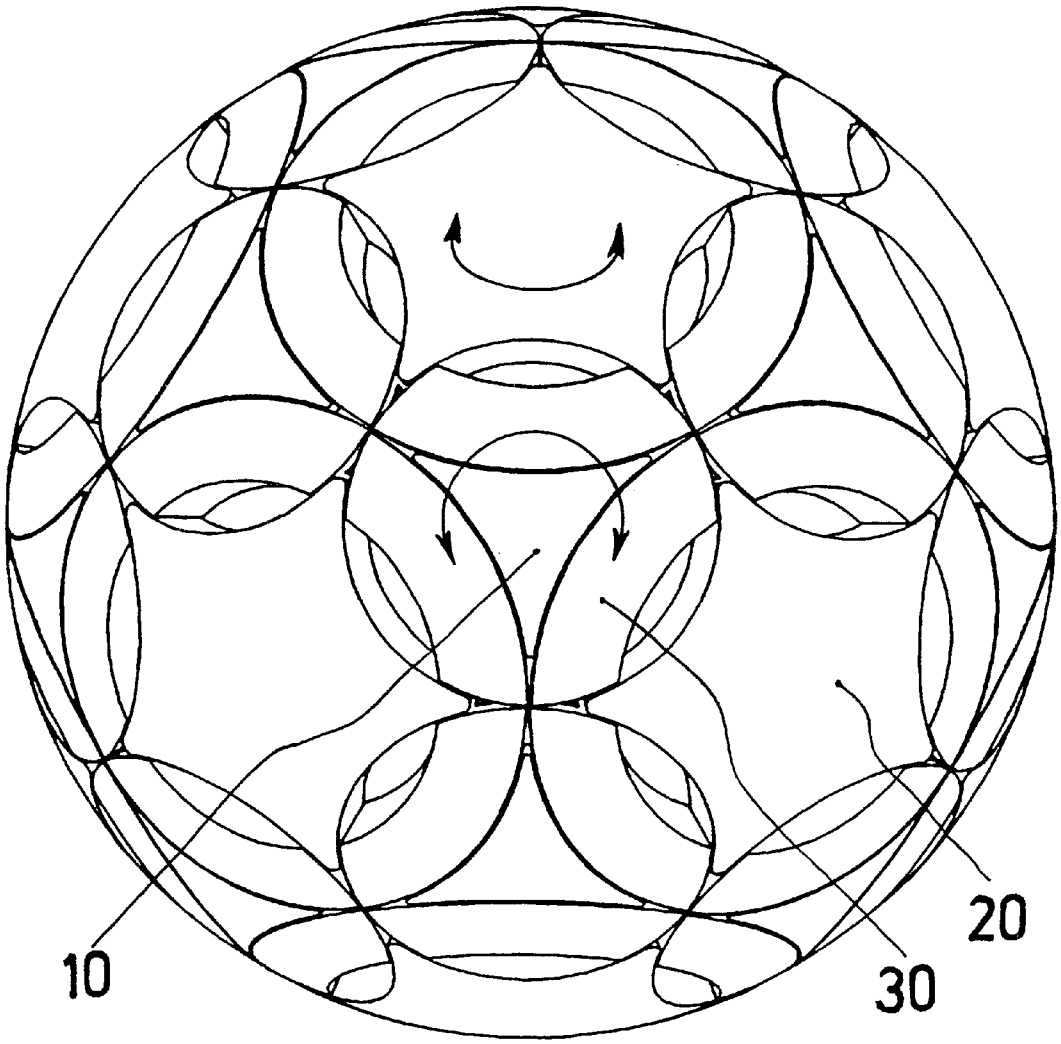
FIG. 1 is an isometric view of the entertainment device.
Figure 2:
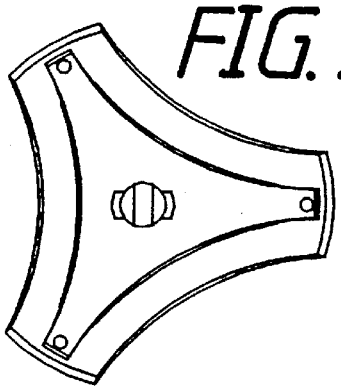
FIG. 2 is a bottom view of the triangular member.
Figure 3:
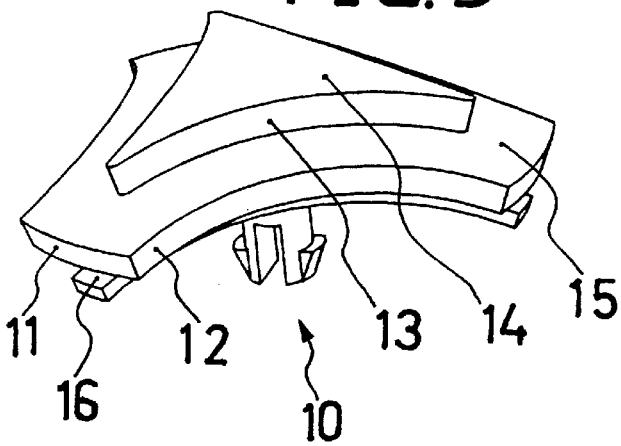
FIG. 3 is an isometric top view of the triangular member.
Figure 4:
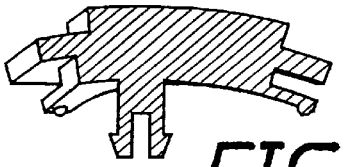
FIG. 4 is a cross-sectional view marked 4—4 in FIG. 6.
Figure 5:
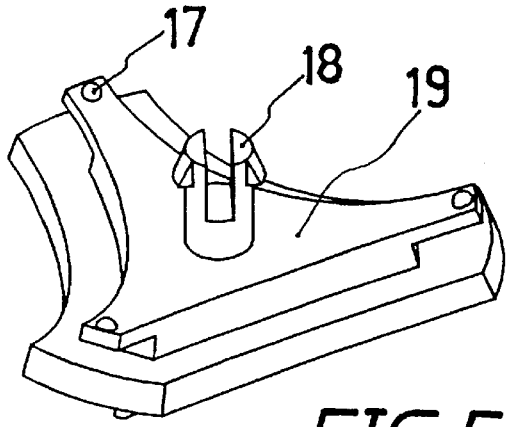
FIG. 5 is an isometric bottom view of the triangular member.
Figure 6:
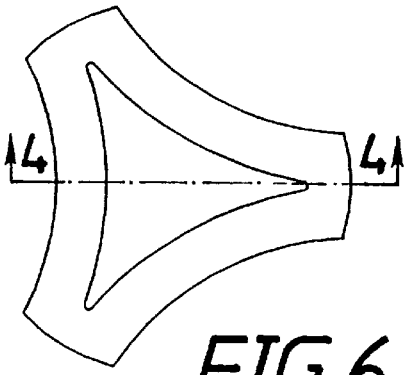
FIG. 6 is a top view of the triangular member.
Figure 7:
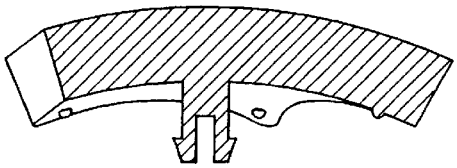
FIG. 7 is a cross-sectional view marked 7—7 in FIG. 9.
Figure 8:
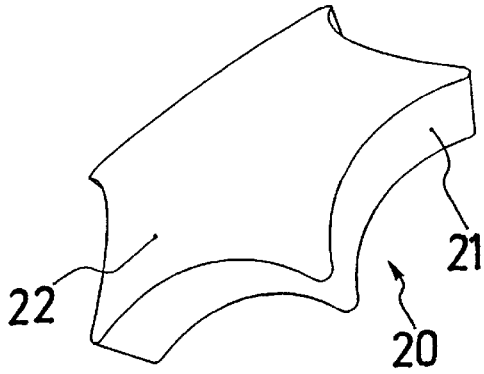
FIG. 8 is an isometric top view of the pentagonal member.
Figure 9:
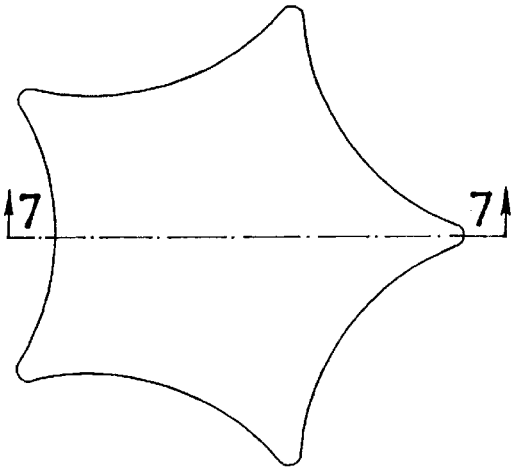
FIG. 9 is a top view of the pentagonal member.
Figure 10:
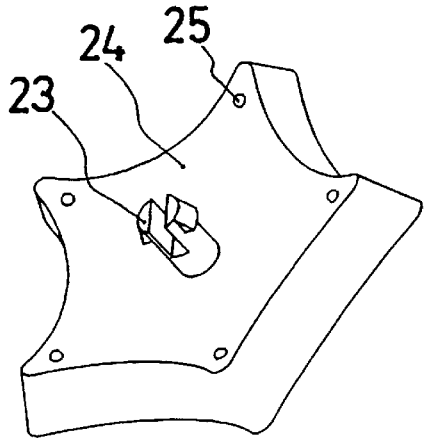
FIG. 10 is an isometric bottom view of the pentagonal member.
Figure 11:
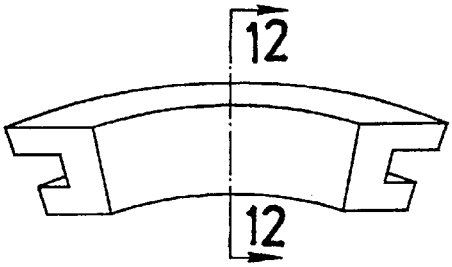
FIG. 11 is a side view of the arcuate moveable piece.
Figure 12:
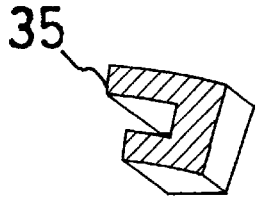
FIG. 12 is a cross sectional view marked 12—12 in FIG. 11.
Figure 13:
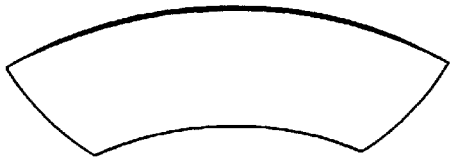
FIG. 13 is a top view of the arcuate moveable piece.
Figure 14:
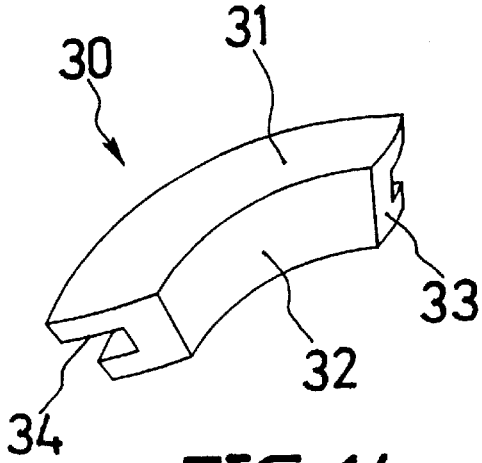
FIG. 14 is an isometric view of the arcuate moveable piece.

| Reference Numerals in drawings | |
|---|---|
| 10 | triangular member |
| 11 | convex peripheral flange |
| 12 | concave peripheral flange |
| 13 | concave peripheral flange |
| 14 | exterior face |
| 15 | peripheral tongue |
| 16 | leg |
| 17 | raised portion |
| 18 | split bolt |
| 19 | interior face |
| 20 | pentagonal member |
| 21 | concave peripheral flange |
| 22 | exterior face |

-continued

| Reference Numerals in drawings | |
|---|---|
| 23 | split bolt |
| 24 | interior face |
| 25 | raised portion |
| 30 | arcuate moveable piece |
| 31 | exterior face |
| 32 | concave peripheral flange |
| 33 | convex peripheral flange |
| 34 | groove |
| 35 | sliding peripheral flange |
| 36 | alternative embodiment of the moveable piece |
| 40 | upper spherical base |
| 41 | hook |
| 42 | hole |
| 43 | dimple |
| 50 | lower spherical base |
| 60 | spherical frame |
| 61 | exterior spherical face |
| 62 | peripheral block |
| 63 | peripheral guiding tongue |
| 64 | concave limiting face |
| 65 | inlet/outlet port |
| 70 | playing piece |
| 80 | channels |
| 90 | planar six-sided member |
| 91 | planar triangular member |
| 92 | planar arcuate moveable piece |

DESCRIPTION OF THE PREFERRED EMBODIMENT

For the purpose of promoting an understanding of the principles of the invention, reference will now be made to the embodiments illustrated in the drawings. Specific language will be used to describe the same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 1 through 21, an entertainment device in accordance with the present invention is generally comprised of a plurality of rotational members divided into two groups: triangular members 10 and pentagonal members 20, a plurality of arcuate moveable pieces 30, and a spherical base 40 and 50 for rotatably supporting said members. Exterior faces of the rotational members and moveable pieces form an exterior sphere concentric to the spherical base. There are twenty triangular members symmetrically disposed around the center of the spherical base. Each triangular member is surrounded by three pentagonal members, the total number of pentagonal members symmetrically disposed around the center of the spherical base being twelve. On the other hand, each pentagonal member is surrounded by five triangular members. Triangular members are centrally positioned between the three neighboring pentagonal members, while pentagonal members are centrally positioned between the five neighboring triangular members. Moveable arcuate pieces 30 are disposed in the areas between a triangular member and a corresponding neighboring pentagonal member, and slidably attached to the triangular member. Each triangular and pentagonal member is rotatable about a respective axis, axes of rotation of all rotational members intersecting each other at the center of the spherical base. When rotating, a triangular member carries the three peripheral arcuate pieces with it. Rotation of a pentagonal member results in simultaneous rotation of five peripheral arcuate pieces. By subsequent rotation of different triangular or pentagonal members with predetermined angular increments, the distribution of the arcuate pieces can be rapidly changed.

FIGS. 2 through 5 illustrate in details the triangular member 10. The exterior face 14 is a portion of the defined exterior sphere, and its boundary is defined by three mutually tangent arcs with centers coincident to the axes of rotation of three neighboring pentagonal members. Three concave peripheral flanges 13 run along the boundary and normal to the exterior face. A tongue 15 is extending radially from the middle portion of the peripheral flanges, the upper and lower face of the tongue being defined by spheres concentric to the exterior sphere. The periphery of the tongue comprises three concave arcuate peripheral flanges 12 concentric to the peripheral flanges of the exterior face, and three convex arcuate peripheral flanges with common center which is coincident to the axis of rotation of the triangular member. The interior face 19 includes legs 16 with raised portions 17. At the center of the triangular member, split bolt 18 protrudes towards the center of the device, along the axis of rotation of the triangular member.

A pentagonal member is illustrated in FIGS. 7 through 10. Its basic geometry is defined by exterior face 22, interior face 24, and five concave peripheral flanges 21. The exterior face 22 resembles a portion of the exterior sphere, and its boundary is defined by five circular arcs with centers coincident to axes of rotation of five neighboring triangular members. Split bolt 23 protrudes in direction of the axis of rotation of the pentagonal member towards the center of the exterior sphere. Raised portions 25 are symmetrically distributed on the interior face.

Referring to FIGS. 11 through 14, arcuate movable piece 30 comprises exterior face 31 that is a portion of the exterior sphere and corresponding interior face, where the boundary of the exterior face is defined by two concentric circular arcs with center coincident to axis of rotation of neighboring pentagonal member, and one circular arc with center coincident to the axis of rotation of neighboring triangular member. Corresponding peripheral flanges run along such defined boundary and normal to the exterior face; wherein convex peripheral flanges 33 are complimentary to concave peripheral flange 21 of an adjacent pentagonal member, sliding peripheral flange 35 is complementary to concave peripheral flange 13 of an adjacent triangular member, and wherein concave peripheral flange 32 is an ergonomic feature that enhances the manual rotation of the members by providing space for inserting the fingers. In other embodiments, this feature may be omitted. Groove 34 is complimentary to peripheral tongue 15 on the triangular member and provides means for sliding the moveable piece along the tongue.

Figure 15:
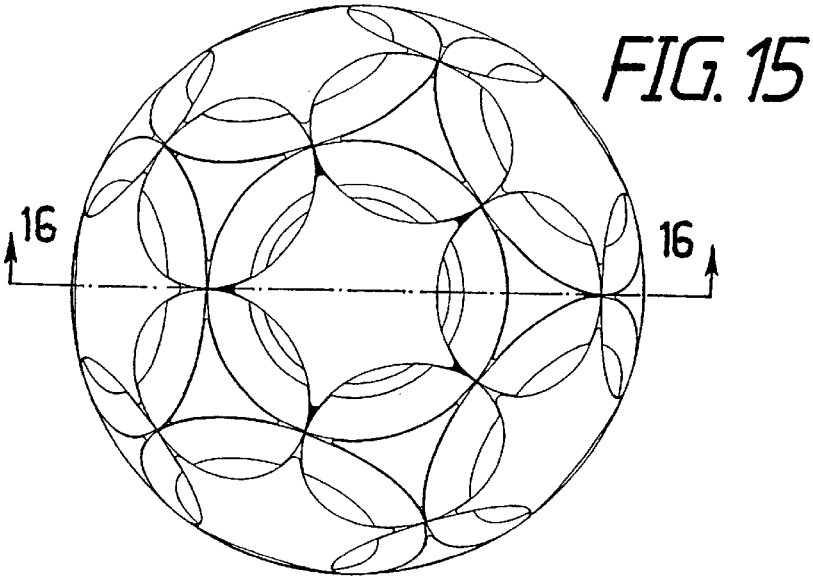
FIG. 15 is an isometric view of the entertainment device.
Figure 16:
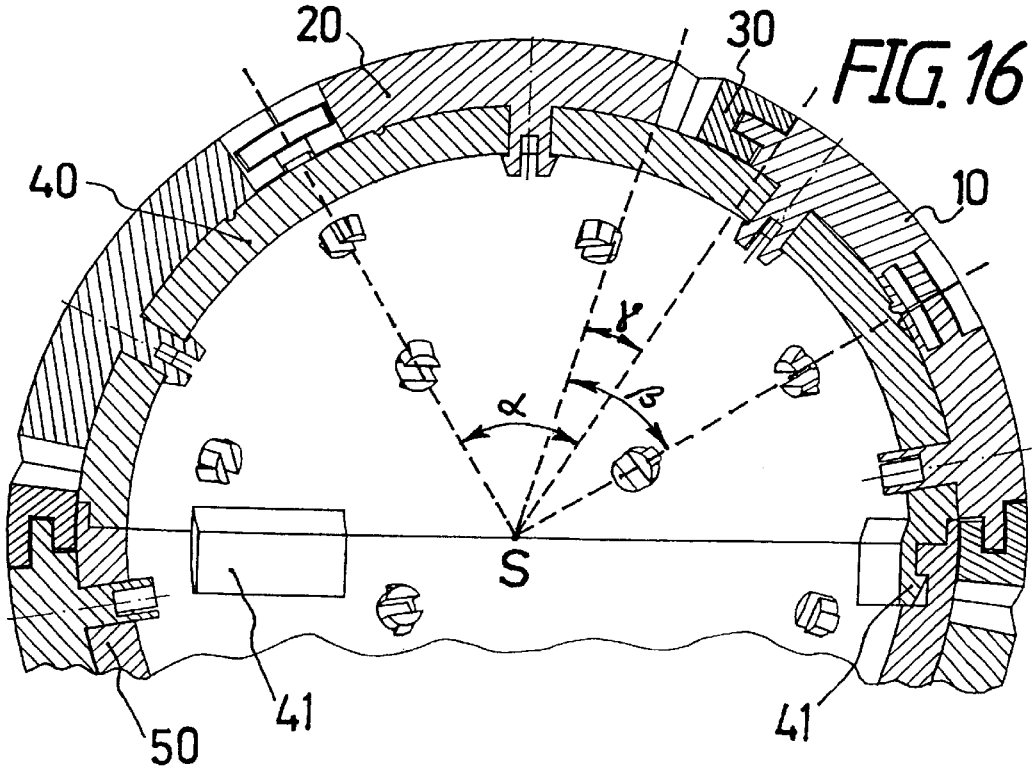
FIG. 16 is a cross sectional view of the entertainment device marked 16—16 in FIG. 15.

FIG. 16 shows a cross-sectional view of the logic puzzle marked in FIG. 15. The triangular and pentagonal members are inserted into spherical base 40 and 50 via corresponding split bolts. The spherical base comprises top hemisphere 40 and bottom hemisphere 50, attached by three hooks 41. This view also illustrates that the elements of the device are fundamentally defined by overlapping conical figures. The figures are defined by two groups of conical bodies. All conical bodies have a common summit point S. The first group has larger summit angle A, and the second group smaller summit angle β. Each body of the first group is tangent to surrounding five conical bodies of the same group, and each body of the second group is tangent to three surrounding conical bodies of the same group. Furthermore, conical bodies of the second group are centrally positioned between three conical bodies of the first group. The conical figures are also defined by an exterior and concentric to it interior sphere with a center coincident to the summit point. Each such defined conical figure comprises a rotational member and plurality of common arcuate pieces on the periphery, the arcuate pieces resembling the overlapping areas of two conical figures of different groups.

Figure 17:
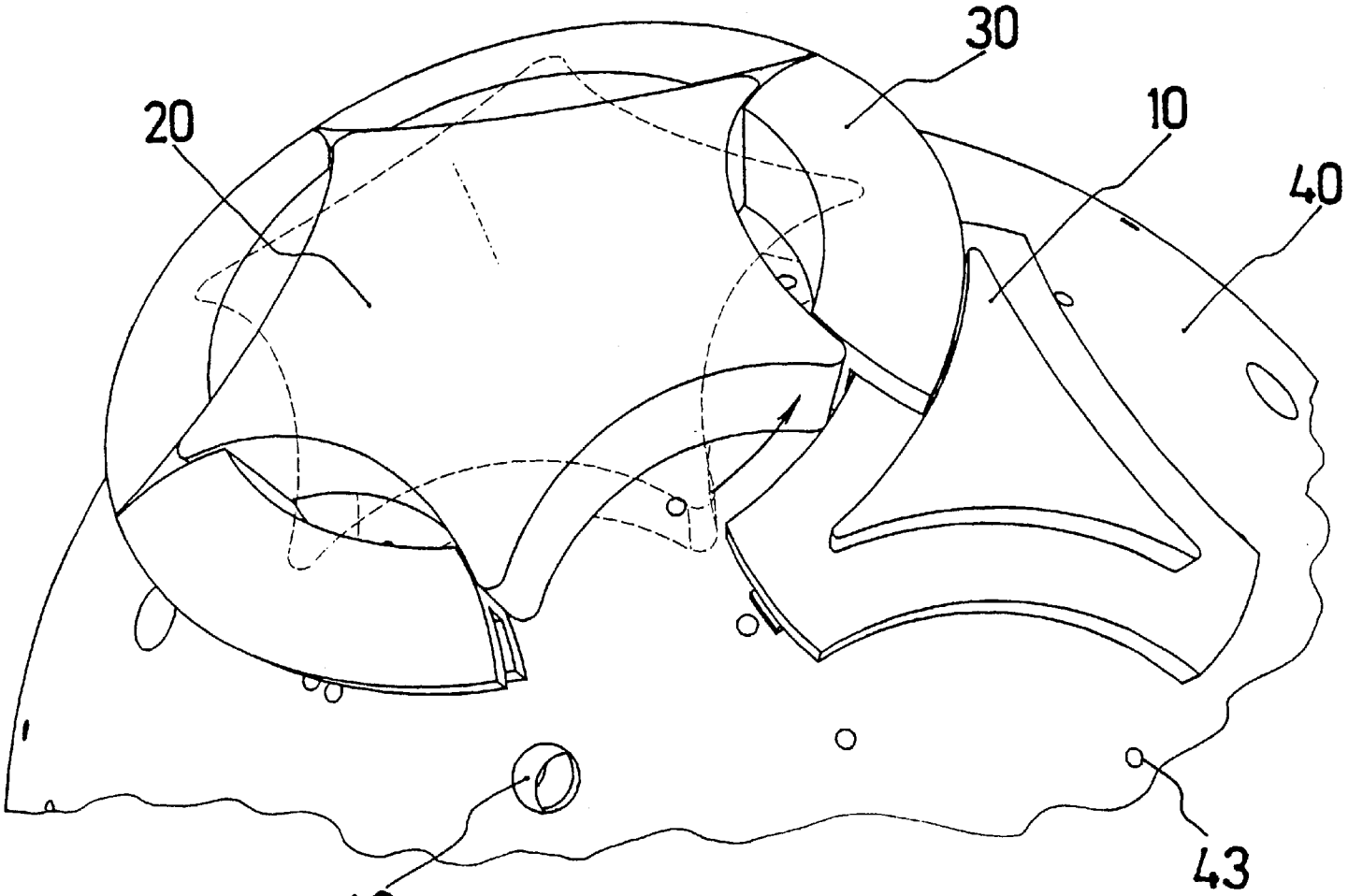
FIG. 17 is an isometric view showing a rotation of a pentagonal member.

Referring to FIG. 17, holes 42 are symmetrically distributed around said spherical base, thereby enabling the rotation for respectively inserted triangular or pentagonal members. In the present embodiment, there are twelve pentagonal members symmetrically distributed around the center of the spherical base, wherein the axes of rotation of any two neighboring pentagonal members compose an angle of 63.44 degrees. The angle composed by the axes of rotation of two neighboring triangular members is 41.81 degrees, and there are total of twenty triangular members. The angle composed by an axis of rotation of a triangular member and an axis of rotation of a neighboring pentagonal member is 37.38 degrees.

FIG. 17 also illustrates a rotation of a pentagonal member together with corresponding moveable pieces relative to the neighboring triangular members. The distance from the tongue 15 (FIG. 3) of the triangular member 10 to the axis of rotation of the pentagonal member 20 is larger than the distance from the same axis to the furthest points of the pentagonal member. This enables the pentagonal member to rotate about its axis without interfering with the neighboring triangular members. On the other hand, the most peripheral areas of the five tentacles of the pentagonal member 20 are substantially in contact with the corresponding convex peripheral flanges 33 (FIG. 14) on the moveable piece 30. Thus, the rotational moment exerted onto the rotational pentagonal member by the player transfers into a peripheral force on the moveable pieces 30. As a result, moveable pieces 30 follow the angular displacement of the pentagonal member, wherein the peripheral groove 34 (FIG. 12) on the moveable piece slides along the tongue on the triangular member. After every incremental rotation of 72 degrees, raised portions 25 (FIG. 10) snap into a corresponding dimple 43 on the spherical base, at which point a subsequent rotation of any other rotational member can occur.

Figure 18:
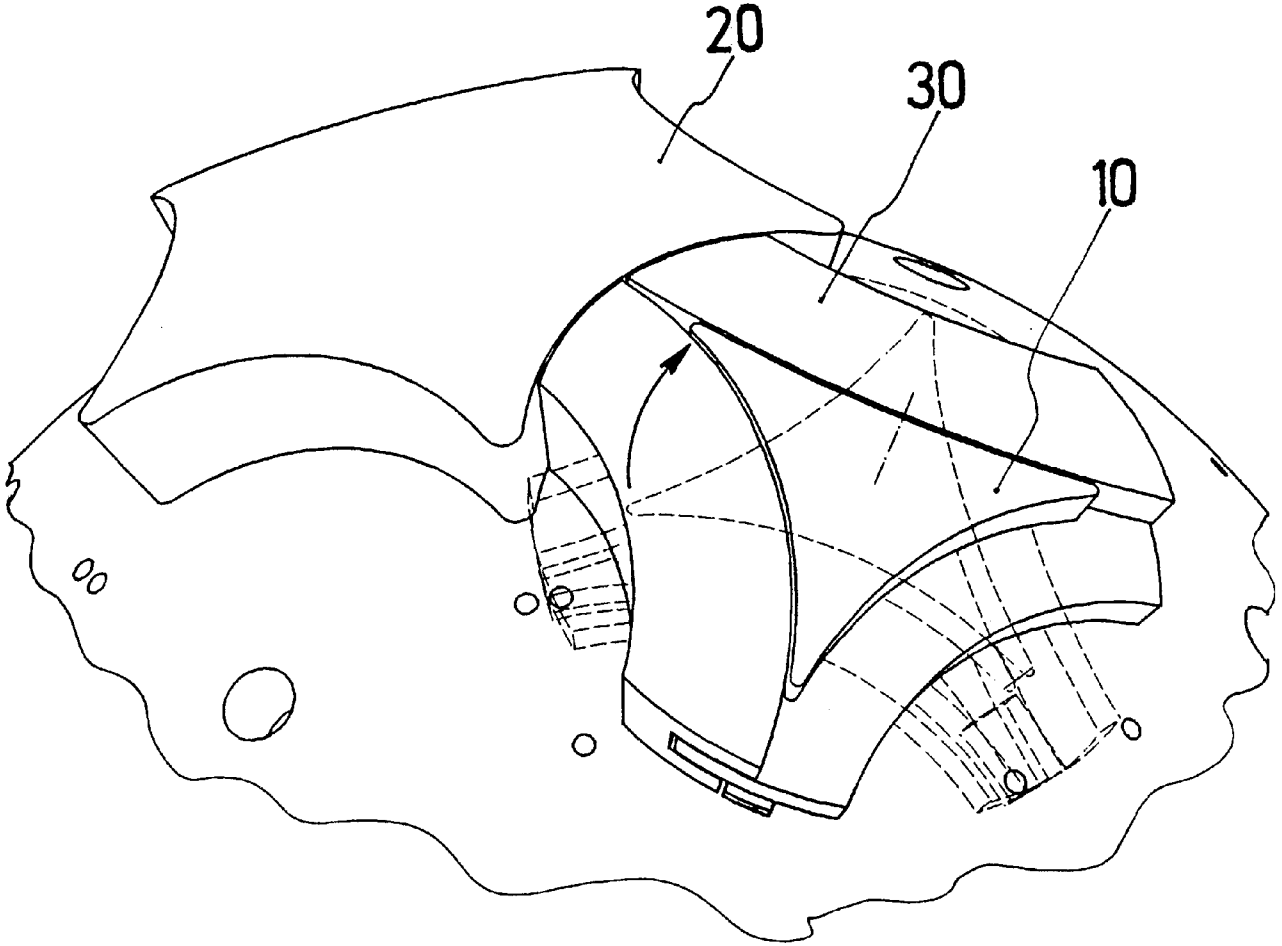
FIG. 18 is an isometric view showing a rotation of a triangular member.

FIG. 18 illustrates a rotation of triangular member 10 relative to neighboring pentagonal member 20. Moveable pieces 30 are nesting a corresponding peripheral tongue 15 (FIG. 3) of the triangular member with groove 34 (FIG. 14) during the rotation. Convex peripheral flanges 11 (FIG. 3) and 33 (FIG. 14) on the triangular member and moveable piece, respectively, lie substantially onto a common conical surface that has an axis coincident to the axis of rotation the triangular member. In this manner, the triangular member together with the slidably attached moveable pieces can rotate freely without affecting the neighboring pentagonal members. Raised portions 17 (FIG. 5) engage corresponding dimples on the spherical base after any incremental rotation of 120 degrees.

The exterior faces of the rotational members and the moveable pieces are provided with distinguishing surface features such as colors and/or numbers and/or letters and/or other indicia. In one particular game, moveable pieces adjacent to a common pentagonal member have a same type of indicia. The moveable pieces are scrambled and the player has to return them to the original position.

Alternative Embodiments

Figure 19:
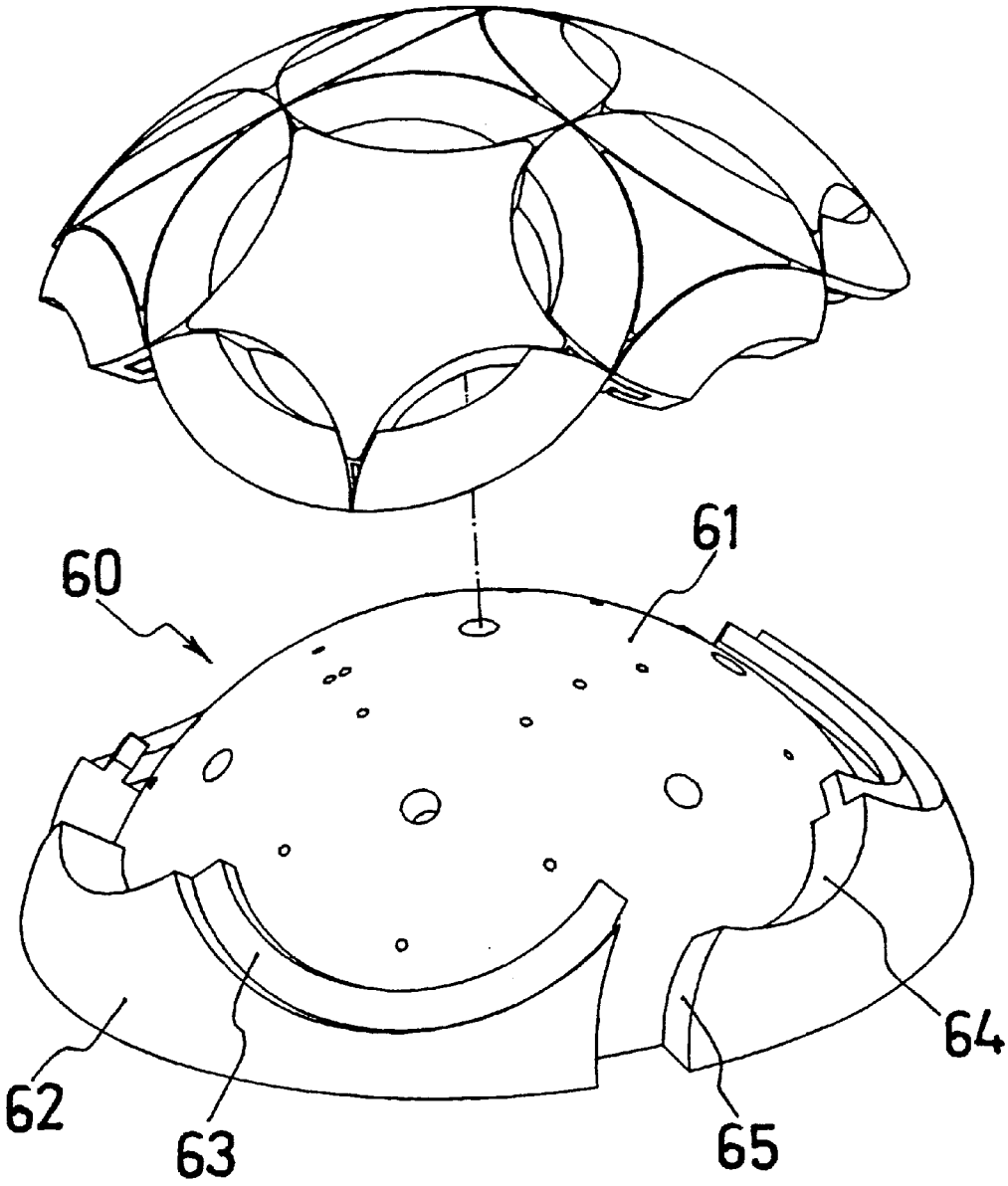
FIG. 19 is an isometric view of a game embodiment of the device.
Figure 20:
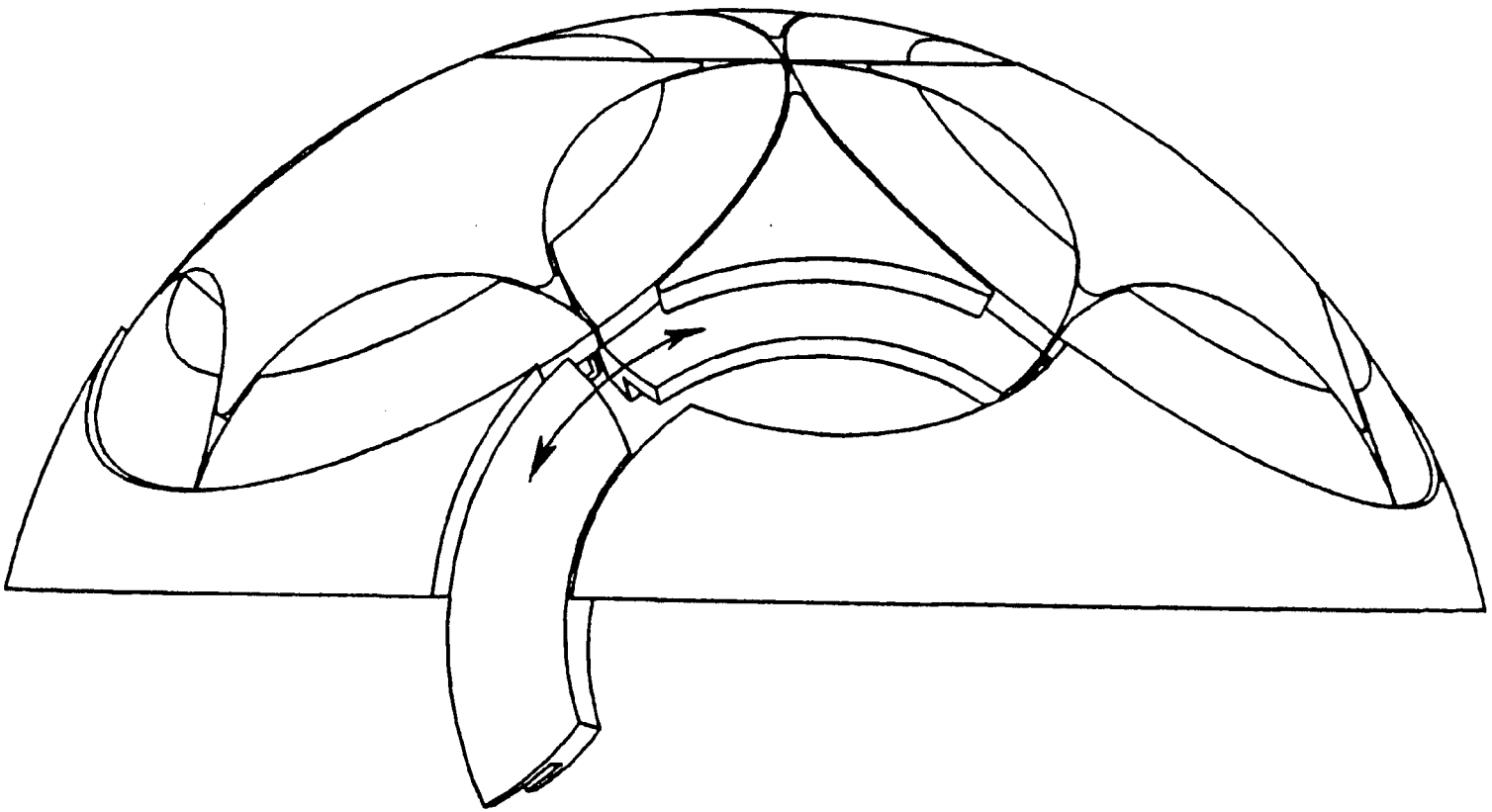
FIG. 20 is a side view of the game embodiment of the apparatus.

FIGS. 19 and 20 illustrate an embodiment of the present invention where a limited number of rotational members combined with a portion of a spherical base are used. In this case, there are three pentagonal members and four triangular members. The rotational members are inserted into corresponding holes of base 60. The base comprises peripheral blocks 62 that provide means for guiding the moveable pieces that find themselves on the boundary of the device. Peripheral guiding tongue 63 enables sliding of moveable pieces that are on the boundary of the device and peripheral to a pentagonal member, whereas concave limiting face 64 preserves a proper position of moveable pieces that are on the boundary of the device and peripheral to a triangular member. Moveable pieces can be introduced to or taken away from the device through inlet/outlet port 65, as illustrated in FIG. 20. This embodiment can be effectively used as a game. In one particular case, the game starts without any moveable pieces into the device. Players make moves alternatively, wherein a move can consists of an introduction of a new piece and/or rotation of a member for changing the distribution of the already introduced pieces. Each of the players has a number of pieces with specific indicia, the goal being to achieve five pieces of same indicia around some of the pentagonal members. Various rules can be introduced to make the game more intellectually challenging.

Figure 21:
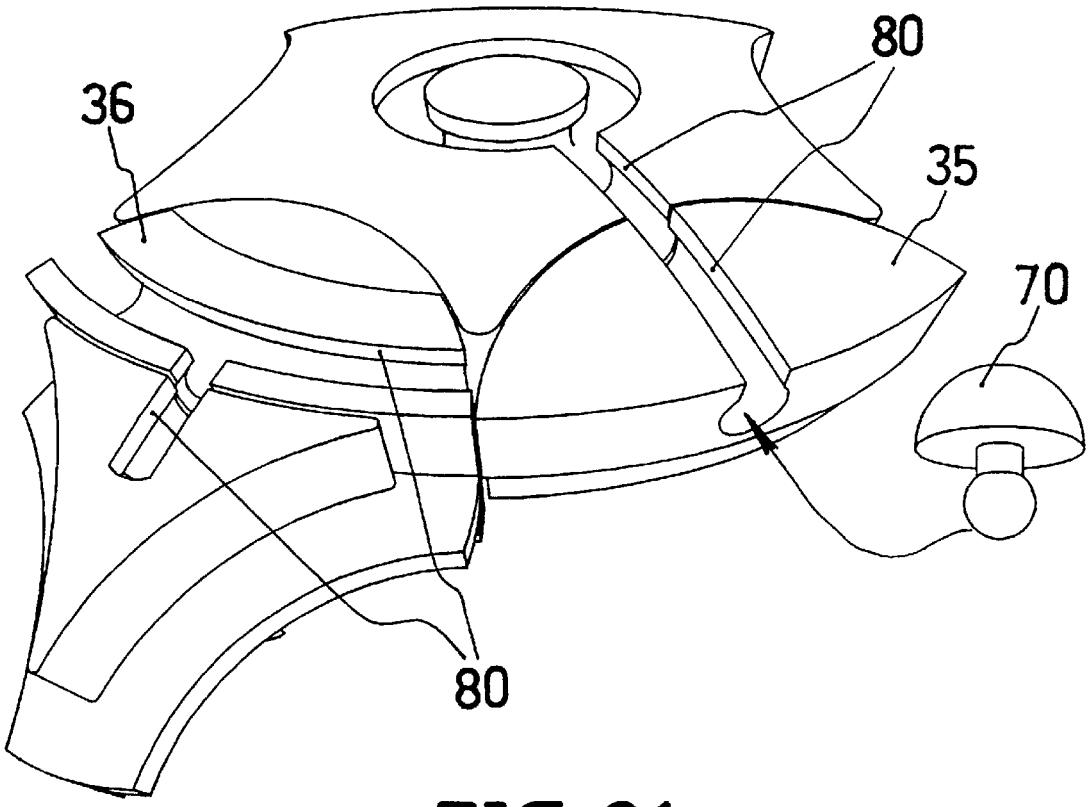
FIG. 21 shows alternative embodiments of the elements of the device.

FIG. 21 illustrates alternative embodiments of the moving elements of the device. Moveable piece 36, compared to the embodiment shown in FIG. 14, does not contain concave peripheral flange 32. This changes the outside appearance of the device, but does not affect its functionality. In another variation, circumferential channels 80 of various forms create paths for playing piece 70 to travel around the device. The distribution of the moveable pieces and the angular disposition of the rotational members affect the channel patterns, thereby making the moving paths of playing pieces 70 a function of the player's creativity.

Figure 22:
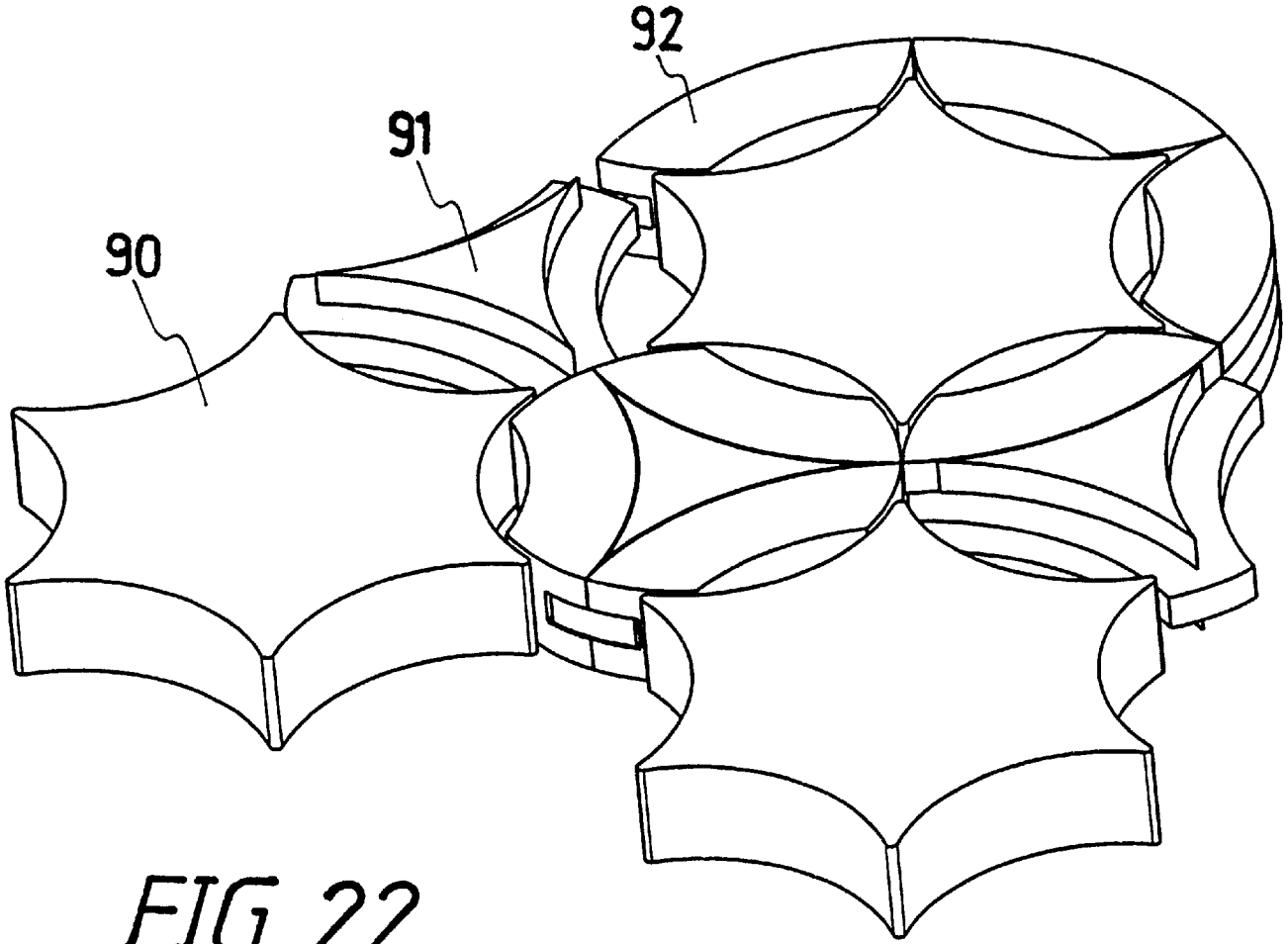
FIG. 22 shows a planar embodiment of the device.

FIG. 22 shows a planar version of the device where the same novel principle is applied. The device comprises six-sided rotational members 90, triangular rotational members 91, and moving pieces 92, wherein the axes of rotation of all rotational members are mutually parallel, and all exterior faces are planar. This embodiment requires a simple frame just for rotatably supporting the rotational members.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. An entertainment device comprising:

(a) a plurality of pentagonal members, each of said pentagonal members having an axis of rotation and comprising an exterior face intersecting said axis at substantially right angle; each of said pentagonal members further comprising five concave peripheral flanges symmetrically distributed around said axis and substantially normal to said exterior face;

(b) a plurality of triangular members, each of said triangular members having an axis of rotation and comprising an exterior face intersecting said axis at substantially right angle, each of said triangular members further comprising three concave peripheral flanges symmetrically distributed around said axis and substantially normal to said exterior face;

(c) a plurality of arcuate movable pieces;

(d) means for slidably attaching said arcuate movable pieces to said triangular members;

(e) a base for rotatably supporting said pentagonal and triangular members;

(f) means for securing the position of said pentagonal and triangular members after rotation in predetermined angular increments;

(g) wherein three of said pentagonal members are adjacent to and symmetrically disposed around each of said triangular members, wherein five of said triangular members are adjacent to and symmetrically disposed around each of said pentagonal members; wherein said exterior face of each of said pentagonal members is substantially defined by five circular arcs of same radius, said five circular arcs having centers coincident to axes of rotation of corresponding five adjacent triangular members; wherein said exterior face of each of said triangular members is substantially defined by three circular arcs of same radius, said three circular arcs having centers coincident to axes of rotation of corresponding three adjacent pentagonal members; wherein each of said triangular and pentagonal members can independently rotate in predetermined angular increments about its own axis of rotation and relative to said base; wherein the axes of rotation of each of said triangular and pentagonal members intersect each other at a common point; wherein said arcuate moveable pieces are disposed in and substantially defined by areas between said triangular members and said pentagonal members; wherein each of said arcuate moveable pieces is adjacent to one of said triangular members and one of said pentagonal members; whereby three of said arcuate moveable pieces are slidably attached to and can simultaneously rotate with each of said triangular members; whereby five of said arcuate moveable pieces can rotate simultaneously with each of said pentagonal members by sliding relative to the adjacent triangular members; wherein the distribution of said arcuate moveable pieces can be changed by sequential rotations of said triangular and pentagonal members in predetermined angular increments.

2. The entertainment device of claim 1 wherein said exterior faces of said triangular and pentagonal members substantially describe a sphere.

3. The entertainment device of claim 1 wherein said means for slidably attaching said arcuate movable pieces to said triangular members comprise a peripheral tongue extruding radially from said three concave peripheral flanges of each of said triangular members; said means further comprising a groove along each of said arcuate moveable pieces; wherein said groove engages said peripheral tongue.

4. The entertainment device of claim 1 wherein each of said arcuate moveable pieces comprises an exterior face; said exterior face being substantially defined by two concentric arcs with center coincident to the axis of rotation of corresponding adjacent pentagonal member and one arc with center coincident to the axis of rotation of corresponding adjacent triangular member; each of said arcuate moveable pieces further comprising peripheral flanges substantially normal to said exterior face.

5. The entertainment device of claim 1 wherein each of said triangular and pentagonal members further comprises a split pin extruded along its own axis of rotation; wherein said base comprises a plurality of holes, said split pin being inserted into corresponding hole on said base thereby enabling rotation of said triangular and pentagonal members relative to said base.

6. The entertainment device of claim 1 wherein said base comprises a spherical shell; said spherical shell having a plurality of holes distributed around the center thereof; said holes having axes coincident to the axes of rotation of said triangular and pentagonal members.

7. The entertainment device of claim 1 wherein said means for securing the position comprise a plurality of raised portions symmetrically distributed about said axis of rotation of each of said triangular and pentagonal members and a plurality of dimples on said base; wherein said raised portions engage corresponding dimples after every incremental rotation of said triangular and pentagonal members.

8. The entertainment device of claim 1 further comprising a plurality of channels on said triangular and pentagonal members and said arcuate moveable pieces; said channels having predetermined cross-sections; said entertainment device further comprising a plurality of playing pieces slidably attached thereto; said playing pieces having cross-sections corresponding to said cross-sections of said channels; wherein said channels provide paths for moving said playing pieces; whereby the pattern of said paths can be changed by rearranging the position of said triangular and pentagonal members and said arcuate moveable pieces.

9. The entertainment device of claim 1 comprising twelve pentagonal members, twenty triangular members and sixty arcuate moveable pieces; wherein the axes of rotation of any two adjacent pentagonal members compose an angle of 63.44 degrees; wherein the axes of rotation of any two adjacent triangular members compose an angle of 41.81 degrees; wherein the axes of rotation of any adjacent pentagonal and triangular members compose an angle of 37.38 degrees.

10. The entertainment device of claim 1 wherein said device is adapted to permit said arcuate moveable pieces to be removed from said device or added by insertion.

* * * * *